US011684962B2

(12) United States Patent
Zhou et al.

(10) Patent No.: US 11,684,962 B2
(45) Date of Patent: Jun. 27, 2023

(54) STAMPING APPARATUS HAVING A PART-TIME DRAW BEAD

(71) Applicants: Dajun Zhou, Troy, MI (US); Chunlei Wang, Rochester Hills, MI (US); Robert D Miller, Lake Orion, MI (US); Kaiping Li, Shelby Township, MI (US); Yongjun Zhou, Rochester Hills, MI (US); Richard J Siemen, Shelby Township, MI (US)

(72) Inventors: Dajun Zhou, Troy, MI (US); Chunlei Wang, Rochester Hills, MI (US); Robert D Miller, Lake Orion, MI (US); Kaiping Li, Shelby Township, MI (US); Yongjun Zhou, Rochester Hills, MI (US); Richard J Siemen, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 2 days.

(21) Appl. No.: 17/347,801

(22) Filed: Jun. 15, 2021

(65) Prior Publication Data

US 2022/0395884 A1 Dec. 15, 2022

(51) Int. Cl.

| | |
|---|---|
| ***B21D 22/00*** | (2006.01) |
| ***B21D 22/22*** | (2006.01) |
| ***B21D 37/10*** | (2006.01) |
| ***B21D 22/06*** | (2006.01) |

(52) U.S. Cl.
CPC ..... *B21D 22/22* (2013.01); *B21D 22/06* (2013.01); *B21D 37/10* (2013.01)

(58) Field of Classification Search
CPC ..... B21D 22/20; B21D 22/21; B21D 22/22
See application file for complete search history.

(56) References Cited

U.S. PATENT DOCUMENTS

| | | | | |
|---|---|---|---|---|
| 6,033,499 | A | 3/2000 | Mitra | |
| 2009/0301163 | A1 | 12/2009 | Hallfeldt et al. | |
| 2012/0318034 | A1 | 12/2012 | Moore et al. | |
| 2015/0107321 | A1* | 4/2015 | Golovashchenko ... | B21D 22/06 72/60 |

* cited by examiner

*Primary Examiner* — Debra M Sullivan
(74) *Attorney, Agent, or Firm* — Ralph E. Smith

(57) ABSTRACT

A stamping apparatus that includes an upper die, a blank-holding binder, and fixed lower die. The fixed lower die features a drawing punch and the upper die features a corresponding cavity. The fixed lower die includes a stake bead and a corresponding depression is present on the upper die. The blank-holding binder includes a draw bead and a corresponding depression is present on the upper die. In the stamping process, the draw bead engages a blank in a first stage, causing the blank to begin to stretch into the shape of the drawing punch with a greater tightened partially finished panel shape. In a second stage, the draw bead disengages the blank as the blank is drawn towards the drawing punch. In a final stage, the stake bead engages the blank to tighten the blank around the drawing punch into a final shape.

16 Claims, 6 Drawing Sheets

STAMPING APPARATUS HAVING A PART-TIME DRAW BEAD

FIELD

The present disclosure relates to an apparatus and method featuring a part-time draw bead for stamping a blank.

BACKGROUND

A stamping apparatus is used to form or "stamp" a metal blank into a finished part that is used for, for example, a panel of a vehicle. The metal blank can be made of a high strength material such as high-strength steel or a high-strength aluminum alloy, which can be difficult to stretch into the proper shape. As best shown in FIG. 7, a conventional stamping apparatus 200 may include a lower die 212, an upper die 214, and a binder 216. Lower die 212 defines a punch 218 having a shape that corresponds to a cavity 220 formed in upper die 214. A metal blank 222 is placed between the lower die 212 and upper die 214 upon punch 218. As upper die 214 is actuated in a direction toward lower die 212, the metal blank 222 will begin to bow at 224 such that metal blank 222 will be spaced apart from an upper surface 226 of punch 218. To ensure that metal blank 222 creates a tight fit around punch 218, a stake bead 228 may be present on lower die 212 of the stamping apparatus 200 that is configured to crimp metal blank 222 and permit metal blank 222 to stretch during the drawing process where punch 218 engages with cavity 220. The stake bead 228, however, does not engage with the metal blank 222 until the final stages of the stamping process. Thus, stake bead 228 does not grip the blank 222 at a time that necessarily inhibits bow 224 from forming. In addition, blank 222 must have a greater size that creates excessive scrap, which is undesirable for cost purposes.

SUMMARY

According to a first aspect of the present disclosure, there is provided a stamping apparatus for stamping a blank. The stamping apparatus comprises a lower die defining a drawing punch. The lower die includes a land portion on opposite sides of the drawing punch that includes a stake bead that extends away from the land portion. A movable upper die includes a cavity that corresponds to and is configured for receipt of the drawing punch with the blank therebetween as the movable upper die moves in a direction toward the lower die. A binder surrounds the lower die and is movable when contacted by the movable upper die. The binder includes a draw bead extending in a direction of the movable upper die. The draw bead is configured to grip an edge of the blank during a first stage where the drawing punch is initially at least partially received within the cavity of the movable upper die and the upper die contacts the binder with the blank therebetween. In a second stage where the drawing punch is further received within the cavity of the movable upper die and the edge of the blank is pulled in a direction toward the drawing punch, the draw bead is configured to disengage from the edge of the blank as the edge of the blank is pulled in the direction toward the drawing punch. After the draw bead has disengaged from the edge of the blank, the stake bead is configured to engage with the edge of the blank and restrict further movement of the edge of the blank toward the drawing punch.

According to the first aspect, the stake bead is configured to engage with the edge of the blank immediately after the draw bead disengages from the edge of the blank.

According to the first aspect, the stake bead is configured to engage with the edge of the blank simultaneously with the draw bead disengaging from the edge of the blank.

According to the first aspect, a height of the stake bead is greater than a height of the draw bead.

According to the first aspect, the draw bead is configured to restrict movement of the edge of the blank toward the drawing punch.

According to the first aspect, the draw bead does not prevent movement of the edge of the blank toward the drawing punch.

According to the first aspect, the stake bead is configured to prevent movement of the edge of the blank toward the drawing punch.

According to the first aspect, the stake bead is a rectangular body having rounded corners.

According to the first aspect, the draw bead is a semicircular-shaped body having a radius of curvature.

According to the first aspect, the blank is comprised of high strength steel.

According to the first aspect, the blank is comprised of high strength aluminum.

According to a second aspect of the present disclosure, there is provided a method of stamping a blank using stamping apparatus including a lower die having a drawing punch surrounded by a land portion that includes a stake bead, an upper die that includes a cavity configured for receipt of the drawing punch therein and that is movable towards and away from the lower die, and a binder that surrounds the lower die that includes a draw bead formed thereon, wherein the binder is movable via contact with the upper die. The method comprises a first stage where as the upper die is moved toward the lower die, the drawing punch is initially received within the cavity of the upper die, and the upper die makes contact with the binder with an edge of the blank located between. The draw bead engages with the edge of the blank to restrict movement of the edge of the blank as the edge of the blank is drawn in a direction toward the drawing punch. In a second stage where the drawing punch is further received within the cavity the draw bead disengages from the edge of the blank as the edge of the blank is further drawing in the direction toward the drawing punch. In a third stage after the draw bead has disengaged from the edge of the blank, the stake bead engages with the edge of the blank and restricts further movement of the edge of the blank in the direction of the drawing punch.

According to the second aspect, the stake bead engages with the edge of the blank immediately after the draw bead disengages from the edge of the blank.

According to the second aspect, the stake bead engages with the edge of the blank simultaneously with the draw bead disengaging from the edge of the blank.

According to the second aspect, a height of the stake bead is greater than a height of the draw bead.

According to the second aspect, the draw bead does not prevent movement of the edge of the blank toward the drawing punch.

According to the second aspect, the stake bead prevents movement of the edge of the blank toward the drawing punch.

According to the second aspect, the stake bead is a rectangular body having rounded corners, and the draw bead is a semicircular-shaped body having a radius of curvature.

According to the second aspect, the blank is comprised of high strength steel.

According to the second aspect, the blank is comprised of high strength aluminum.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
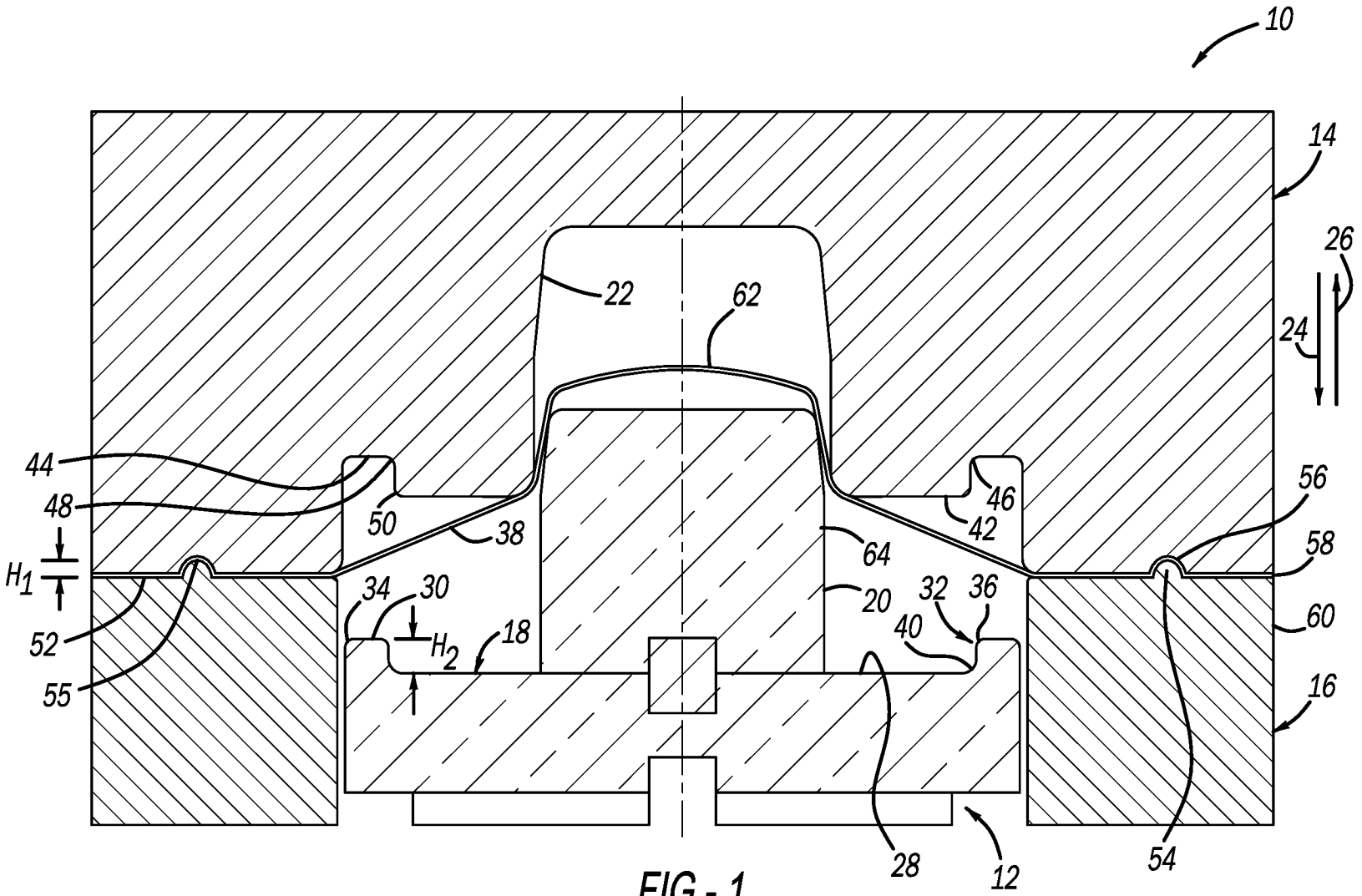
FIG. 1 is a cross-sectional view of an exemplary stamping apparatus in a first stage according to a principle of the present disclosure.

Example embodiments will now be described more fully with reference to the accompanying drawings.

Firstly, it should be understood that spatially relative terms, such as "inner," "outer," "beneath," "below," "lower," "above," "upper," and the like that may be used below are for ease of description to describe one element or feature's relationship to another elements or features as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 180 degrees or at other orientations) and the spatially relative descriptors used herein interpreted accordingly.

FIGS. 1-4 are cross-sectional views of an example stamping apparatus 10 according to a principle of the present disclosure. The stamping apparatus 10 includes a fixed lower die 12, an upper die 14, and blank-holding binder 16. The fixed lower die 12 has an upper surface portion 18 defining a drawing punch 20 having a shape that corresponds to that of a cavity 22 formed in upper die 14, with the shape of drawing punch 20 and cavity 22 defining a shape an article to be drawn by stamping apparatus 10. The upper die 14 is positioned above the fixed lower die 12, and may be actuated in a downward direction 24 and an upward direction 26 by a hydraulic or mechanical drive device (not shown) towards and away, respectively, from lower die 12. The blank-holding binder 16 surrounds or juxtaposes the fixed lower die 12 and is positioned below the upper die 14. The blank-holding binder 16 is movable in downward direction 24 by drive device (not shown) via contact with upper die 14. Although not illustrated, it should be understood that a plurality of cushion pins may be positioned beneath binder 16 that support binder 16 and cushion binder 16 as it is moved in the downward direction 24.

The fixed lower die 12 has a land portion 28 surrounding or juxtaposing the drawing punch 20. The land portion 28 of the fixed lower die 12 is a general planar surface that includes a first blank-holding surface 30 defined by a male stake bead 32. The male stake bead 32 extends away from the land portion 28 of the fixed lower die 12 in upward direction 26 toward upper die 14. The male stake bead 32 may be defined as a generally rectangular shape with a first corner 34 and second corner 36 separated by blank-holding surface 30. First corner 34 and second corner 36 each may have a radius of curvature is (i.e., are rounded) such that corners 34, 36 do not define sharp edges that may crack or tear a blank 38 when blank 38 is gripped by stake bead 32. The radius of each corner 34 and 36 may be the same, or may be different. A transition 40 between stake bead 32 and land portion 28 may also have a radius of curvature. While blank-holding surface 30 is illustrated as being generally planar, it should be understood that blank-holding surface 30 may also have a radius of curvature.

Upper die 14 includes a surface 42 surrounding or juxtaposing the cavity 22 that corresponds to land portion 28. In addition, surface 42 includes a first depression 44 that is shaped to correspond and is configured for receipt of stake bead 32 with blank 38 therebetween. First depression 44, therefore, also includes radiused portion 46, 48, and 50 that correspond to corners 34, 36, and transition 40, respectively.

Blank holding binder 16 includes a generally planar surface 52 having a draw bead 54 extending outward toward upper die 14, which has a corresponding second depression 56 that is shaped and configured for receipt to draw bead 54 therein with blank 38-positioned therebetween. Draw bead 54 includes a radiused surface 55, and may be designed to have a height H1 that may be less than a height H2 of stake bead 32. The reason H1 may be less than H2 will be described in more detail below.

In operation, the metal blank 38 is placed between fixed lower die 12 and the upper die 14 such that blank 38 lies atop blank holding binder 16 and drawing punch 20. The dimensions of blank 38 are such that a terminal edge 58 of blank 38 is located outboard from draw bead 54. While edge 58 is illustrated as extending to an edge 60 of blank-holding binder 16, it should be understood that edge 58 is not required to extend to edge 60 of binder 16, but instead may be located between edge 60 and draw bead 54.

A first stage of the stamping process is shown in FIG. 1. As illustrated in FIG. 1, upper die 14 has been actuated by drive device (not shown) in downward direction 24 toward fixed lower die 12, and upper die 14 has made contact with blank-holding binder 16 with blank 38 positioned therebetween. In this stage, blank 38 is gripped between draw bead 54 and second depression 56, and cavity 22 of upper die 14 has begun to receive drawing punch 20. Because blank 38 has been gripped by draw bead 54, movement of edge 58 of blank 38 in a direction toward drawing punch 20 is restricted, but not prevented. Moreover, because cavity 22 has begun receiving drawing punch 20 with blank 38 therebetween, a portion 62 of blank 38 that was previously atop drawing punch 20 may have a tendency to bow away from drawing punch 20. The distance that portion 62 bows away from drawing punch 20, however, is restrained due to the gripping of blank 38 by draw bead 54.

Figure 7:
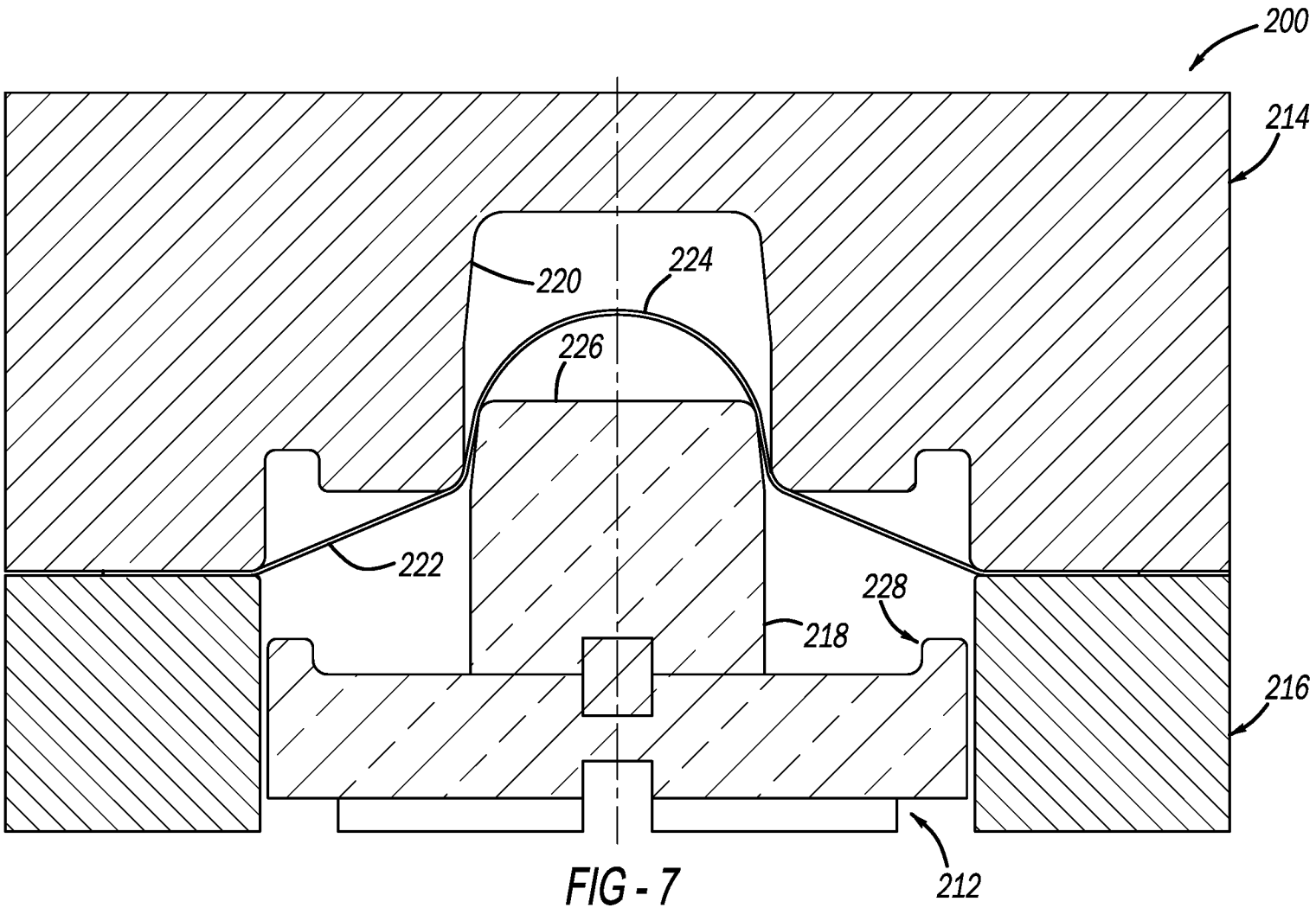
FIG - 7 (Prior Art)
FIG. 7 is a cross-sectional view of a conventional stamping apparatus having a plurality of stake beads.

More specifically, if draw beads 54 were not present to grip the edge 58 of blank 38, the portion 62 would bow away from drawing punch 20 as shown in FIG. 7, which is undesirable because the increased bowing increases the likelihood that blank 38 will experience springback after the stamping process is completed. In other words, in order to minimize springback of the blank 38 after the stamping process is completed, it is desirable to minimizing bowing at portion 62 as much as possible such that portion 62 is located closer to drawing punch 20 during the first stage of the stamping process. According to the present disclosure, the bowing of blank 38 at portion 62 is minimized due to the gripping of edge 58 of blank 38 by draw bead 54.

Figure 2:
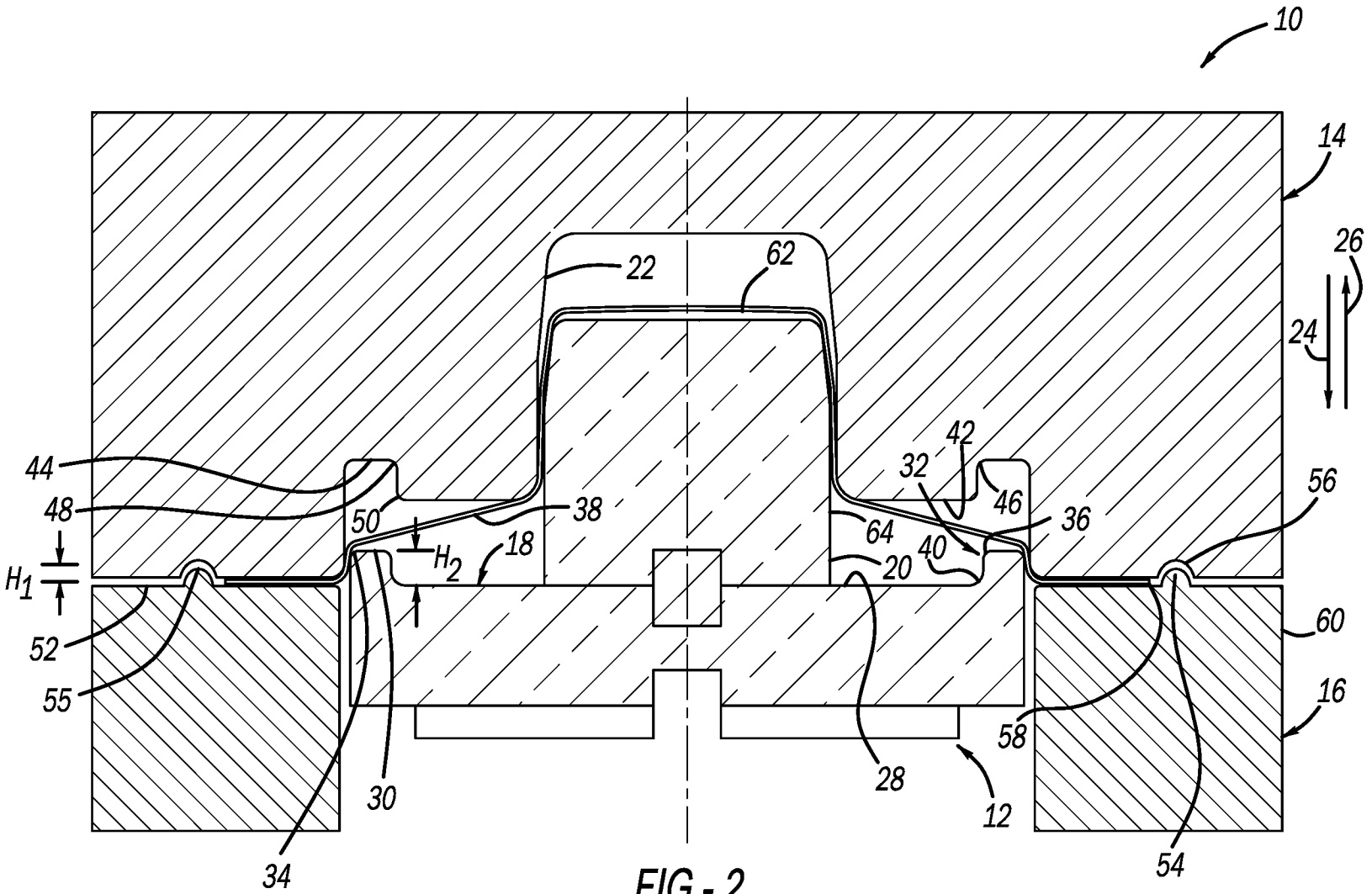
FIG. 2 is a cross-sectional view of the exemplary stamping apparatus illustrated in FIG. 1 in a second stage according to a principle of the present disclosure.

FIG. 2 shows a second stage of stamping the metal blank 38. As the upper die 14 and the blank-holding binder 16 continue to move in downward direction 24 toward the fixed lower die 12, drawing punch 20 is further received within cavity 22, which causes the edge 58 of the metal blank 38 to be drawn towards the drawing punch 20. In the second stage, as the edge 58 is drawn toward drawing punch 20, the metal blank 38 will disengage from draw bead 54. It should be noted, however, that due to the initial restriction of movement of blank 38 by draw bead 54, portion 62 of blank 38 is bowed to a lesser extent relative to drawing punch 20 in comparison to that shown in FIG. 1. FIG. 2 also illustrates that blank 38 has begun to be engaged by stake bead 32. This initial engagement between blank 38 and stake bead 32 occurs shortly after or simultaneous with blank 38 disengaging from draw bead 54, and enables the decreased bowing at portion 62 in comparison to FIG. 1.

Figure 3:
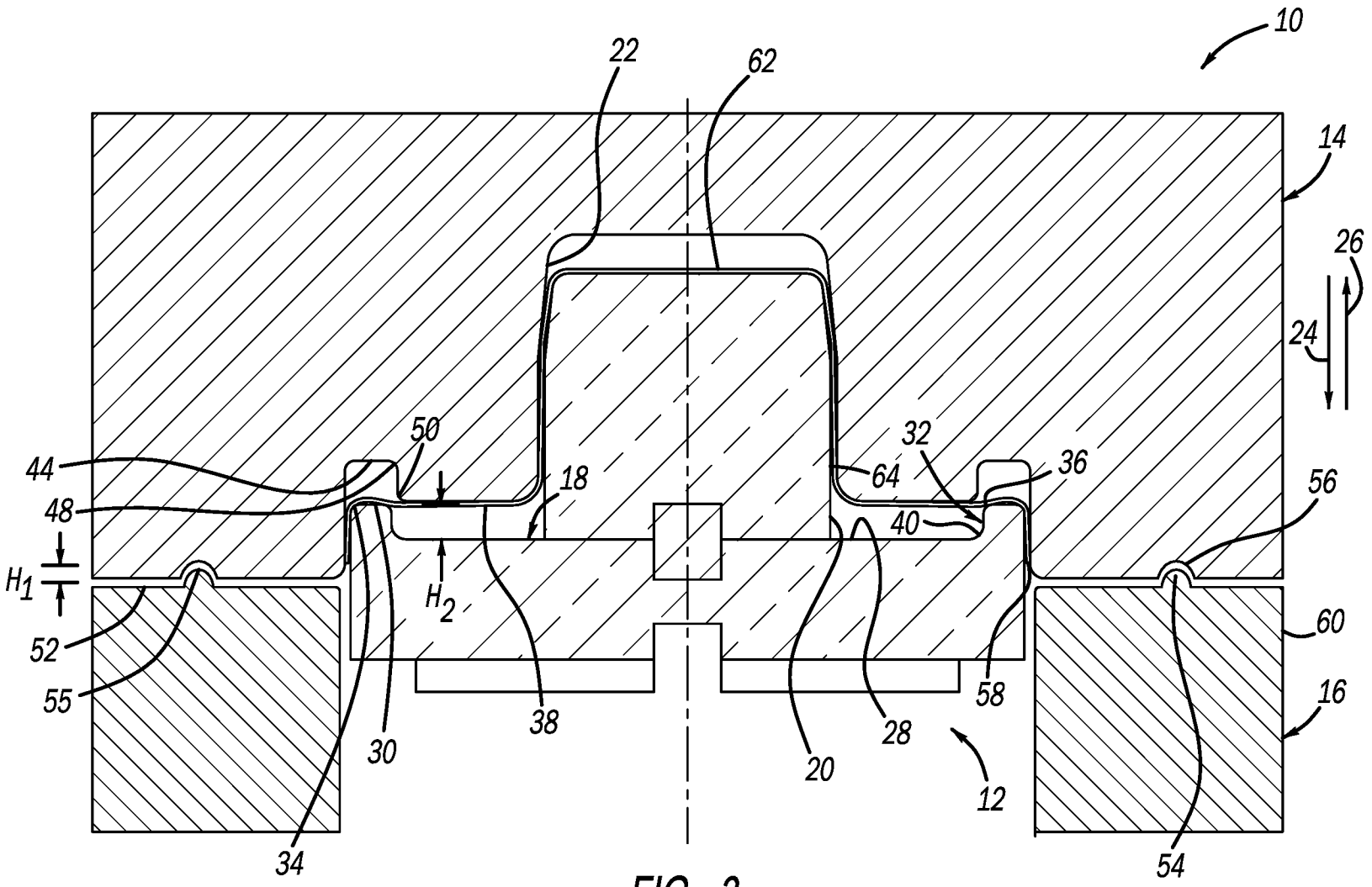
FIG. 3 is a cross-sectional view of the exemplary stamping apparatus illustrated in FIG. 1 in a third stage according to a principle of the present disclosure.

Now referring to FIG. 3, a third stage is illustrated where the upper die 14 and the blank-holding binder 16 continue to move in downward direction 24 toward the fixed lower die 12, and male stake bead 32 further engages with metal blank 38. The further engagement between male stake bead 32 and metal blank 38 enables bowing of blank 38 at portion 62 to be removed such that blank 38 at portion 62 is in contact with drawing punch 20. This is because, in the third stage illustrated in FIG. 3, stake bead 32 begins to restrict movement of blank 38, which enables blank 38 to begin to stretch as drawing punch 20 is further received within cavity 22.

Figure 4:
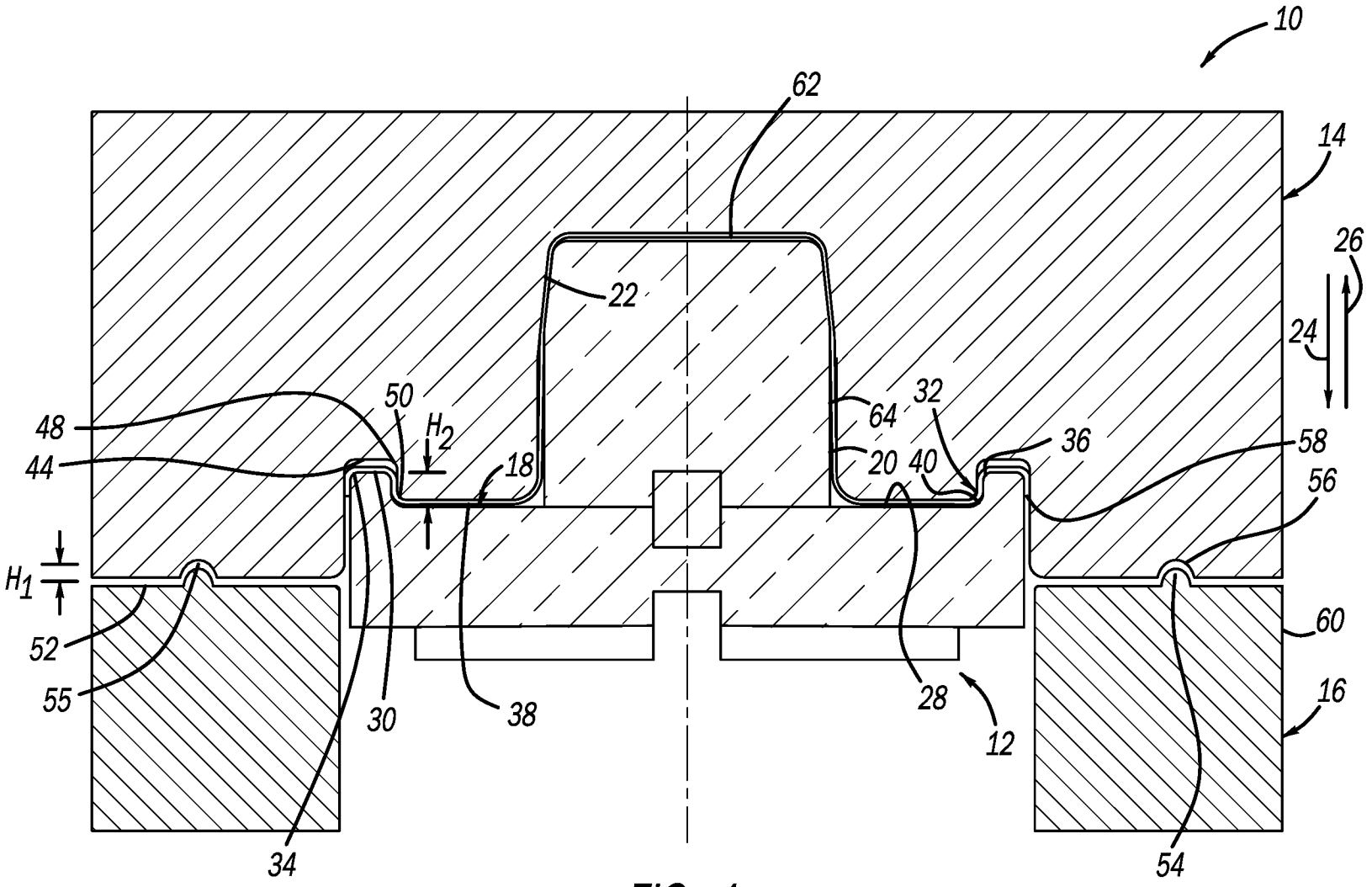
FIG. 4 is a cross-sectional view of the exemplary stamping apparatus illustrated in FIG. 1 in a final stage according to a principle of the present disclosure.

In a final stage, shown in FIG. 4, drawing punch 20 has been fully received within cavity 22, and blank 38 is fully gripped by stake bead 32. Due to the full engagement of blank 38 by stake bead 32, the edge 58 of blank 38 is fully restricted from being drawn towards drawing punch 20, which enables blank 38 to be stretched at portion 62 and at portions that extend alongside surfaces 64 of drawing punch 20 to form the final article. Thereafter, upper die 14 may be actuated by drive device (not shown) in upward direction 26 away from lower die 12, and blank 38 in the shape of the final article may be removed from stamping apparatus 10.

According to the above-described configuration, the stamping process is conducted in stages that controls the timing at which blank 38 is first gripped by draw beads 54 and then gripped by stake beads 32. By controlling the timing at which blank 38 is gripped by draw beads 54 and stake beads 32, the amount of bowing at portion 62 of blank 38 can be controlled that permits increased stretching of blank 38 during the stamping process, while also inhibiting springback that is experienced by blank 38 when upper die 14 is released from engagement with drawing punch 20 of fixed lower die 12. Importantly, height H1 of draw beads 54 is less than height H2 of stake beads 32. The lesser height H1 of draw beads 54 leads to a lesser draw-in restraining force between blank 38 and draw beads 54 such that movement of blank 38 will only be restricted by draw beads 54 rather than prevented like when stake bead 32 is engaged with blank 38. Notwithstanding, the restriction of movement of blank 38 by draw beads 54 for a controlled amount of time enables the bowing of blank 38 at portion 62 relative to drawing punch 20 to be minimized. Moreover, because blank 38 is subsequently or simultaneously gripped by stake beads 32 after disengagement of blank 38 from draw beads 54, the dimensions of blank 38 may be reduced, which enables a reduction in scrap. In addition, by controlling the timing at which blank 38 is disengaged from draw beads 54 and gripped by stake beads 32, blank 38 is permitted to stretch a greater extent in comparison than when using a stamping apparatus 200 like that shown in FIG. 7 that does not include draw beads 54, which reduces springback of blank 38 when upper die 14 is moved away from lower die 12.

Figure 5:
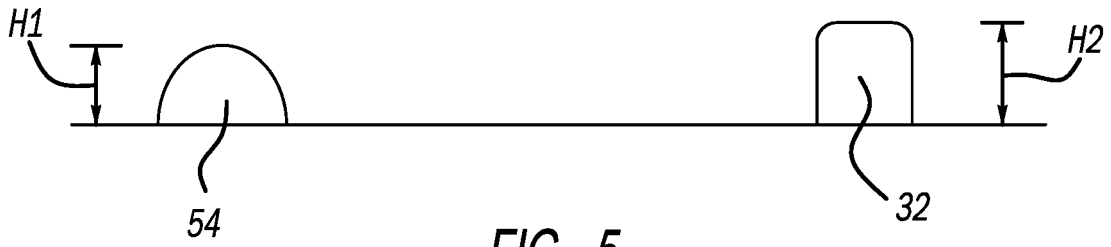
FIG. 5 is a partial cross-sectional view of a stake bead and a draw bead of an exemplary stamping apparatus according to a principle of the present disclosure.
Figure 6:
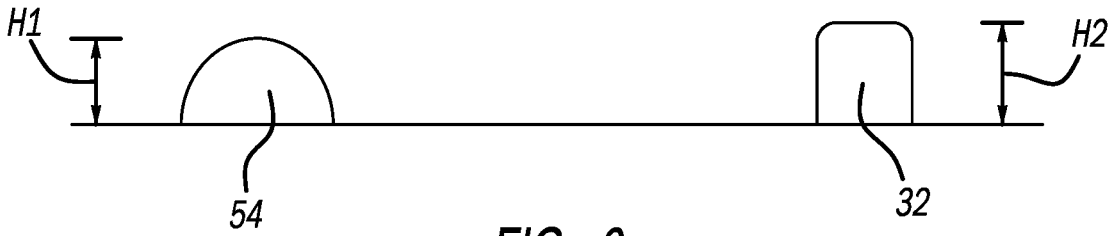
FIG. 6 is a partial cross-sectional view of a stake bead and a draw bead of an exemplary stamping apparatus according to a principle of the present disclosure.

FIGS. 5 and 6 schematically illustrate the difference in heights H1 and H2 between the draw bead 54 and stake bead 32. It should be understood that each height H1 and H2 is variable, and may be selected based on the desired restraining force between the blank 38 at each stage of the stamping process, as well as based on the material that forms blank 38. For example, as shown in FIG. 5, if a blank 38 formed of high strength steel having a tensile strength of 1000 MPa is to be drawn, the height H1 of draw bead 54 may be in the range of greater than zero up to 6 mm and the height H2 of stake bead 32 may be in the range of greater than 6 mm (e.g., 6.6 mm) up to 9.6 mm. Regardless of the heights H1 and H2 selected for draw bead 54 and stake bead 32, the important aspects to keep in mind are that draw bead 54 is designed to restrict movement of the edge 58 of blank 38 toward punch 20 rather than prevent movement like the stake bead 32, and the height H1 of draw bead 54 is selected to control the timing at which the edge 58 of blank is permitted to pass draw bead 54 before being gripped by stake bead 32. In addition, while draw bead 54 is illustrated as being rounded in FIG. 5, it should be understood that the shape of draw bead 54 may be similar to that of stake bead 32 (i.e., generally rectangular in shape while having rounded corners).

Preferably, as shown in FIG. 6, the height H1 of draw bead 54 is in the range of 2 mm up to 6 mm, and the height H2 of stake bead 32 is in the range of 7.6 mm up to 9.6 mm when drawing a blank 38 formed of high strength steel having a tensile strength of 1000 MPa. Most preferably, the height H1 of draw bead 54 is in the range of 4 mm up to 6 mm, and the height H2 of stake bead 32 is in the range of 8.6 mm up to 9.6 mm when drawing a blank 38 formed of high strength steel having a tensile strength of 1000 MPa. It should also be understood that the above-described ranges can be applicable to other high-strength materials such as aluminum or other metal and alloy materials.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stamping apparatus for stamping a blank, comprising:

a lower die defining a drawing punch, the lower die including a land portion on opposite sides of the drawing punch that includes a stake bead that extends away from the land portion;

a movable upper die including a cavity that corresponds to and is configured for receipt of the drawing punch with the blank therebetween as the movable upper die moves in a direction toward the lower die; and a binder that surrounds the lower die and is movable when contacted by the movable upper die;

wherein the binder includes a draw bead extending in a direction of the movable upper die;

wherein the draw bead is configured to grip the blank at a location proximate an edge of the blank during a first stage where the drawing punch is initially at least partially received within the cavity of the movable upper die and the upper die contacts the binder with the blank therebetween, wherein in a second stage where the drawing punch is further received within the cavity of the movable upper die and the edge of the blank is pulled in a direction toward the drawing punch, the draw bead is configured to disengage from the blank as the edge of the blank is pulled in the direction toward the drawing punch, and wherein either immediately after or simultaneously with the draw bead disengaging from the edge of the blank, the stake bead is configured to engage with the the blank and restrict further movement of the edge of the blank toward the drawing punch.

2. The stamping apparatus of claim 1, wherein a height of the stake bead is greater than a height of the draw bead.

3. The stamping apparatus of claim 1, wherein the draw bead is configured to restrict movement of the edge of the blank toward the drawing punch.

4. The stamping apparatus of claim 3, wherein the draw bead does not prevent movement of the edge of the blank toward the drawing punch.

5. The stamping apparatus of claim 3, wherein the stake bead is configured to prevent movement of the edge of the blank toward the drawing punch.

6. The stamping apparatus of claim 1, wherein the stake bead is a rectangular body having rounded corners.

7. The stamping apparatus of claim 1, wherein the draw bead is a semicircular-shaped body having a radius of curvature.

8. The stamping apparatus of claim 1, wherein the stamping apparatus is configured for stamping a blank that is comprised of high strength steel.

9. The stamping apparatus of claim 1, wherein the stamping apparatus is configured for stamping a blank that is comprised of high strength aluminum.

10. A method of stamping a blank using stamping apparatus including a lower die having a drawing punch surrounded by a land portion that includes a stake bead, an upper die that includes a cavity configured for receipt of the drawing punch therein and that is movable towards and away from the lower die, and a binder that surrounds the lower die that includes a draw bead formed thereon, the binder being movable via contact with the upper die, the method comprising:

a first stage where as the upper die is moved toward the lower die, the drawing punch is initially received within the cavity of the upper die, and the upper die makes contact with the binder with an edge of the blank located between, the draw bead engages with the blank at a location proximate the edge to restrict movement of the edge of the blank as the edge of the blank is drawn in a direction toward the drawing punch;

a second stage where as the drawing punch is further received within the cavity the draw bead disengages from the blank as the edge of the blank is further drawing in the direction toward the drawing punch; and a third stage where either immediately after or simultaneously with the draw bead disengaging from the edge of the blank, the stake bead engages with the the blank and restricts further movement of the edge of the blank in the direction of the drawing punch.

11. The method of claim 10, wherein a height of the stake bead is greater than a height of the draw bead.

12. The method of claim 10, wherein the draw bead does not prevent movement of the edge of the blank toward the drawing punch.

13. The method of claim 12, wherein the stake bead prevents movement of the edge of the blank toward the drawing punch.

14. The method of claim 10, wherein the stake bead is a rectangular body having rounded corners, and the draw bead is a semicircular-shaped body having a radius of curvature.

15. The method of claim 10, wherein the blank is comprised of high strength steel.

16. The method of claim 10, wherein the blank is comprised of high strength aluminum.

* * * * *